US005231715A

United States Patent [19]

Strobel

[11] Patent Number: 5,231,715

[45] Date of Patent: Aug. 3, 1993

[54] REINFORCED FRAME FOR WATERBED

[76] Inventor: Mark J. Strobel, 3131 Industrial Pkwy., Jeffersonville, Ind. 47130

[21] Appl. No.: 898,683

[22] Filed: Jun. 15, 1992

[51] Int. Cl.[5] ..... A47C 19/00

[52] U.S. Cl. ..... 5/400; 5/451; 5/917

[58] Field of Search ..... 5/451, 450, 449, 452, 5/400, 401, 917

[56] References Cited

U.S. PATENT DOCUMENTS

| | | | |
|---|---|---|---|
| 3,838,470 | 10/1974 | May | 5/451 |
| 4,395,797 | 8/1983 | May | 5/451 |
| 4,625,351 | 12/1986 | Campian | 5/401 |
| 4,675,929 | 6/1987 | Santo | 5/400 |

FOREIGN PATENT DOCUMENTS

| | | | |
|---|---|---|---|
| 2172198 | 9/1986 | United Kingdom | 5/907 |

*Primary Examiner*—Alexander Grosz
*Attorney, Agent, or Firm*—James B. Middleton

[57] ABSTRACT

A water bed frame has four rails to define a container for a water mattress, and at least the side rails include flanges fixed to the rails and extending beneath the water mattress. The flanges may be fixed to the bottom surface of the beam making up the rail, or may be received within a groove parallel to the bottom surface of the beam. The flanges provide a wider rail area to prevent the rails from falling off the deck, the weight of the mattress on the flanges tends to hold the frame stationary with respect to the deck, and the flanges provide sufficient strength to prevent bowing of the side rails from the outward force exerted by the water mattress. All four of the rails may include flanges if desired.

1 Claim, 1 Drawing Sheet

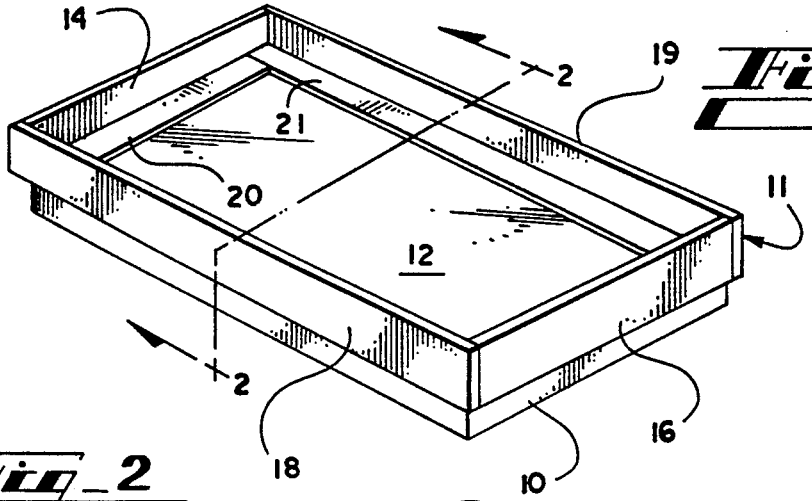
Fig_1
Fig_2
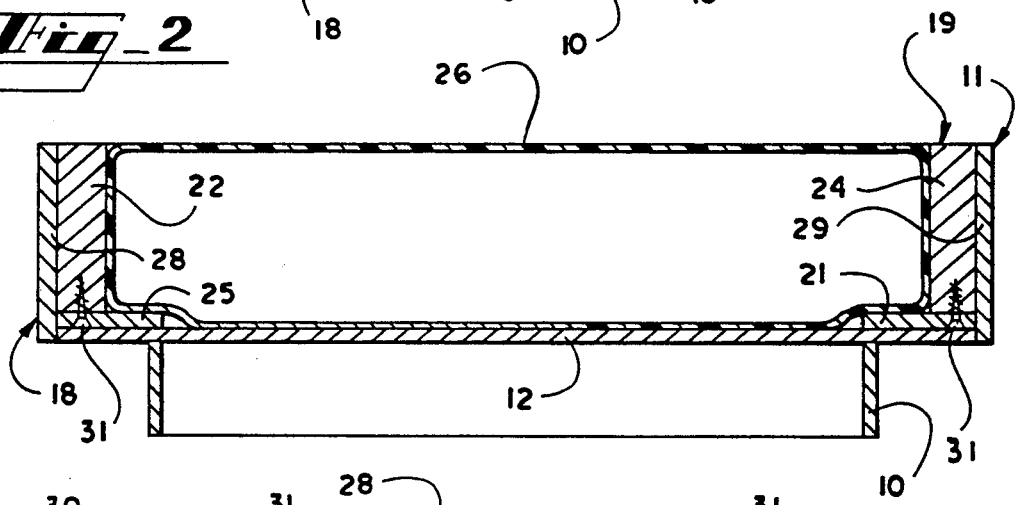
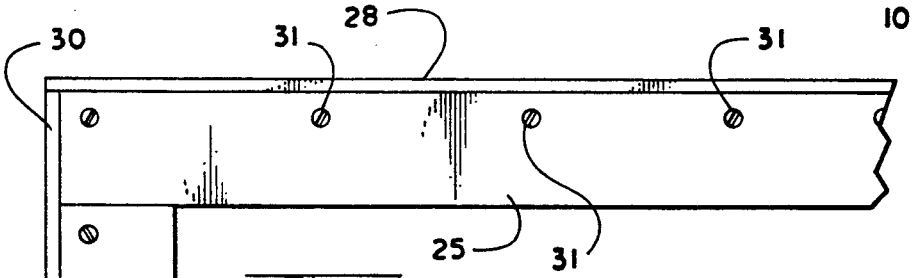
Fig_3
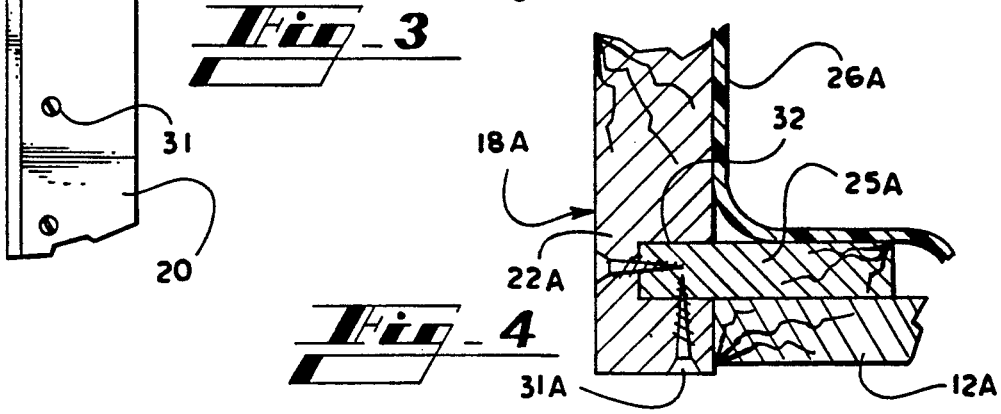
Fig_4

REINFORCED FRAME FOR WATERBED

FIELD OF THE INVENTION

This invention relates generally to waterbed frames, and is more particularly concerned with a bed frame having reinforced rails to prevent bowing of the rails.

BACKGROUND OF THE INVENTION

A recognized problem in water beds is the force exerted on the rails of the bed, especially on the side rails. Because the side rails must be quite long, the force constantly exerted by the water in the mattress tends to cause bending or bowing of the rails. Even though the rails for full flotation mattresses are relatively heavy wooden beams, the force of the water is sufficient to cause bending over a period of time.

The most common effort at preventing the bending of the side rails of water beds is to fasten at least the center portion of the rail to the deck of the bed. Such a technique provides additional support in the center of the rail, which does counteract the outwardly directed forces. Connection of the side rails to the deck is usually accomplished by installing angle brackets which are screwed to both the rails and the deck. The brackets therefore both prevent bending of the rails and assist in holding the rails on the deck.

The problems with the angle brackets are, first, that the brackets are difficult to install. It will be understood that a water bed is generally assembled by the user; and, while most of the assembly is quite easy, the ordinary user has trouble inserting wood screws into the rails and deck of the bed frame. Also, if only a single bracket is used on each rail, the constantly exerted forces will eventually bend the angle bracket or cause the screws to pull out, and allow bending or bowing of the rail.

Thus, the prior art has not provided a simple and practicable solution to the problem of the bending of side rails for a water bed.

SUMMARY OF THE INVENTION

The present invention provides a frame for a water bed in which the rails of the bed frame have bottom flanges fixed thereto and extending inwardly of the frame. The invention contemplates the provision of bottom flanges on at least the two side rails, though the flanges may be provided on the head and foot rails as well. The bottom flanges therefore offer resistance to bending of the rails, and also extend inwardly, under the mattress so the weight of the mattress assists in holding the frame on the deck. As a result, the frame of the present invention does not need to be fastened to the deck, but the rails will remain on the deck unattached and unbowed.

It is contemplated that the rails of the present invention can be shipped ready to assemble into the bed, so the ordinary user will be able to assemble the bed frame without difficulty. Alternatively, the rails and the flanges may be shipped unassembled, but with screw holes pre-drilled for easy assembly by a novice.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing a bed frame made in accordance with the present invention;

FIG. 2 is an enlarged, cross-sectional view taken substantially along the line 2—2 in FIG. 1;

FIG. 3 is a fragmentary bottom plan view showing the construction of one corner of the frame shown in FIG. 2; and, FIG. 4 is a fragmentary, cross-sectional view showing an alternative construction for use with the present invention.

DETAILED DESCRIPTION OF THE EMBODIMENTS

Referring now more particularly to the drawings, and to those embodiments of the invention here presented by way of illustration, FIG. 1 shows a water bed frame including a base 10, and a frame generally designated at 11 resting on the deck 12. The deck is supported by the base 10. The frame 11 comprises head and foot rails 14 and 16 joined by side rails 18 and 19. It can be seen in FIG. 1 that the head rail 14 includes an inwardly directed flange 20 and the side rail 19 includes an inwardly directed flange 21 at the bottom of the rails.

The specific construction of the frame of the present invention is shown in FIG. 2 of the drawings. Here it will be noticed that the base 10 receives the deck 12 as is conventional. The rails of the bed frame then rest on the upper surface of the deck 12. Whereas, in the conventional bed frame, the rails 18 and 19 comprise only the heavy beams 22 and 24, in the frame of the present invention the beams 22 and 24 are augmented by the flanges 21 and 25. As a result, there is a considerable amount of effective width of the rails 18 and 19 to prevent the rails from slipping off the deck 12.

It will be seen in FIG. 2 of the drawings that the beams 22 and 24 have their longer dimension oriented vertically. This is necessary to achieve the required depth of the frame to contain the water mattress 26. The narrower dimension, then, is left to withstand the outward forces of the water mattress 26. The strength of a member such as the beams 22 and 24 is directly proportional to the width of the member, but directly proportional to the cube of the thickness. Since the forces on the members 22 and 24 will be directed laterally, this is the direction that is the "thickness". The "width" is perpendicular to the force, and is the height of the members 22 and 24.

In view of the above, it will be understood that a small change in the "thickness" of the members 22 and 24 will result in a large change in the strength of the member. Nevertheless, the usual members are about two inches thick, and an increase in this dimension would greatly increase the weight of the member, and would greatly increase the cost. The solution to the problem, therefore, is to provide the bottom flanges 25 and 21.

Those skilled in the art will understand that the greater force against the rails 11 is at the bottom of the rails, adjacent to the deck, because of the head of water. As a result, the use of flanges on the bottom of the rails places the maximum strength at the point of maximum stress.

In addition to providing the strength to prevent bowing of the rails, and providing this strength at the point of greatest stress, the use of the inwardly directed bottom flanges yields a holding force for holding the frame 11 on the deck 12. The mattress 26 overlies a portion of the flanges 25, 21 and 20, and the weight of the mattress will prevent motion of the frame 11 with respect to the deck 12.

Attention is directed to FIGS. 2 and 3 for a discussion of the detailed construction of the rails of the frame 11. It will be recognized that one generally wishes to cover the edges of boards to hide the less attractive end grain. Also, it is common in water bed frames to allow the rails to overlap the edge of the deck to assist in holding the rails on the deck. In the construction shown in FIGS. 2 and 3, the flanges 20, 25 and 21 extend completely under the members 22 and 24. Face plates 28, 29 and 30 therefore cover the members 22 and 24, and extend down sufficiently to cover the edge of the deck 12.

The flanges 20, 21 and 25 are easily attached to the rails by a plurality of wood screws 31. It is desirable for additional strength to apply glue before attaching the flanges, but the glue will prevent easy disassembling and may be dispensed with.

An alternative construction for the rails of the present invention is shown in FIG. 4 of the drawings. The construction in FIG. 4 includes the side rail (for example) 18A and a deck 12A. A water mattress 26A is contained by the rail 18A.

The flange 25A is received within a groove 32 in the member 22A, and a portion of the member 22A extends below the flange 25A to cover the edge of the deck 12A. Wood screws 31A can be used to secure the flange 25A in the groove 32, and of course glue can be added for greater strength.

It will therefore be seen that the embodiment of the invention shown in FIG. 4 has the same functional features as the embodiment shown in FIGS. 1–3. The flange 25A has a large dimension in the direction of forces exerted against the rail, so the flange 25A will provide adequate strength to prevent bowing of the rail. Also, the weight of the mattress 26A on the flange 25A will hold the rail against the deck 12A.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A frame for a water bed, said frame being adapted to receive a water mattress therein, said frame comprising a deck adapted to support a water mattress, a plurality of rails including a head rail, a foot rail and opposed side rails, each rail of said plurality of rails including a beam having a bottom surface and a height substantially the same as the height of the water mattress, each of said opposed side rails defining a groove therein parallel to the bottom surface of said beam, and flanges, generally rectangular in cross section, secured in said grooves and extending outwardly from said grooves to partially overlap peripheral portions of said decking and to extend beneath a water mattress.

* * * * *